US008397467B2

(12) United States Patent
Krell

(10) Patent No.: US 8,397,467 B2
(45) Date of Patent: Mar. 19, 2013

(54) METHODS AND APPARATUS FOR CONCRETE PANEL CONNECTIONS

(75) Inventor: Clinton C. Krell, Waukesha, WI (US)

(73) Assignee: The Spancrete Group, Inc., Waukesha, WI (US)

( * ) Notice: Subject to any disclaimer, the term of this patent is extended or adjusted under 35 U.S.C. 154(b) by 418 days.

(21) Appl. No.: 12/317,982

(22) Filed: Dec. 31, 2008

(65) Prior Publication Data

US 2010/0162655 A1 Jul. 1, 2010

(51) Int. Cl.
*E04B 1/00* (2006.01)

(52) U.S. Cl. ..... 52/745.11; 52/253; 52/713; 52/745.13

(58) Field of Classification Search ..... 52/712–714, 52/250–253, 258, 259, 334, 650.3, 745.21, 52/745.09, 745.1, 745.11, 745.13, 745.14
See application file for complete search history.

(56) References Cited

U.S. PATENT DOCUMENTS

| | | | | |
|---|---|---|---|---|
| 814,134 | A * | 3/1906 | Hood | 52/489.1 |
| 1,205,465 | A | 11/1916 | Maguire et al. | |
| 2,053,873 | A | 9/1936 | Niederhofer | |
| 2,139,623 | A | 12/1938 | Marston | |
| 2,337,743 | A | 12/1943 | Deuel | |
| 2,592,634 | A | 4/1952 | Wilson | |
| 2,691,291 | A | 10/1954 | Henderson | |
| 3,319,387 | A | 5/1967 | Stewing et al. | |
| 3,495,371 | A | 2/1970 | Mitchell, Jr. | |
| 3,510,997 | A | 5/1970 | Ratych | |
| 3,621,624 | A | 11/1971 | Gustafson | |
| 3,693,308 | A | 9/1972 | Trezzini et al. | |
| 3,724,141 | A | 4/1973 | Kelleher | |
| 3,772,835 | A | 11/1973 | Cox et al. | |
| 3,898,776 | A | 8/1975 | Cox et al. | |
| 3,918,222 | A | 11/1975 | Bahramian | |
| 3,952,471 | A | 4/1976 | Mooney | |
| 4,001,990 | A | 1/1977 | Chase et al. | |
| 4,100,705 | A | 7/1978 | Diana | |
| 4,231,199 | A | 11/1980 | Gomez et al. | |
| 4,240,233 | A | 12/1980 | Vercelletto | |

(Continued)

FOREIGN PATENT DOCUMENTS

| | | |
|---|---|---|
| WO | WO91/02855 | 3/1991 |

OTHER PUBLICATIONS

Office Action dated Feb. 25, 2011; in related case U.S. Appl. No. 12/319,027, filed Dec. 31, 2008.

(Continued)

*Primary Examiner* — William Gilbert
(74) *Attorney, Agent, or Firm* — Ryan Kromholz & Manion, S.C.

(57) ABSTRACT

Methods and apparatus for coupling adjacent concrete panels increase the tolerance for setting. Connections members are placed in at least one of the adjacent concrete panels. In one embodiment a first connection member is placed in a first panel and a second connection member is placed in a second panel. A plate is placed over the first and second connection member. Fasteners are inserted through the plate and into each connection member to secure the adjacent panels together. In a second embodiment a rotatable connection member is placed in a first panel. The rotatable connection member includes a first rod rotatably coupled to a second rod. The second panel is placed on the first panel. The connection member is rotated from its first position to its second position and is secured to the second panel. The connection members may be cast in the panels during production.

7 Claims, 5 Drawing Sheets

U.S. PATENT DOCUMENTS

| | | | | |
|---|---|---|---|---|
| 4,398,378 | A | | 8/1983 | Heitzman |
| 4,513,545 | A | | 4/1985 | Hopkins, Jr. |
| 4,545,159 | A | | 10/1985 | Rizk |
| 4,569,167 | A | | 2/1986 | Staples |
| 4,598,515 | A | | 7/1986 | Diana |
| 4,627,205 | A | | 12/1986 | Hitchins |
| 4,655,016 | A | | 4/1987 | Jacob |
| 4,759,160 | A | | 7/1988 | Fischer |
| 4,768,938 | A | | 9/1988 | Greeson |
| 4,909,001 | A | | 3/1990 | Gonzalez Espinosa de Los Monteros |
| 5,081,805 | A | * | 1/1992 | Jazzar ..... 52/79.2 |
| 5,313,753 | A | | 5/1994 | Sanger |
| 5,381,635 | A | | 1/1995 | Sanger |
| 5,487,241 | A | | 1/1996 | Gorrell et al. |
| 5,671,582 | A | | 9/1997 | Reay |
| 5,678,372 | A | | 10/1997 | Thomson et al. |
| 5,761,862 | A | | 6/1998 | Hendershot et al. |
| 5,794,386 | A | | 8/1998 | Klein |
| 5,845,441 | A | | 12/1998 | Swartz |
| 5,865,001 | A | | 2/1999 | Martin et al. |
| 5,987,827 | A | | 11/1999 | Lord |
| 6,058,672 | A | | 5/2000 | McClellan |
| 6,073,401 | A | | 6/2000 | Iri et al. |
| 6,119,417 | A | | 9/2000 | Valverde et al. |
| 6,260,320 | B1 | | 7/2001 | DiLorenzo |
| 6,643,981 | B2 | | 11/2003 | Pina et al. |
| 6,668,507 | B2 | | 12/2003 | Blanchet |
| 6,698,150 | B1 | | 3/2004 | DiLorenzo |
| 6,955,016 | B1 | | 10/2005 | Churches et al. |
| 6,976,344 | B2 | | 12/2005 | Sanger |
| 7,007,431 | B2 | | 3/2006 | Schubert |
| 7,121,061 | B2 | | 10/2006 | Jazzar |
| 7,147,197 | B2 | | 12/2006 | Dalton |
| 2002/0069602 | A1 | | 6/2002 | Blanchet |
| 2007/0028531 | A1 | | 2/2007 | Woodcock |
| 2008/0060293 | A1 | | 3/2008 | Hanlon |
| 2008/0066395 | A1 | | 3/2008 | Aranda et al. |

OTHER PUBLICATIONS

Office Action dated Oct. 14, 2011 regarding U.S. Appl. No, 12/319,027, 11 pages.

Office Action dated Apr. 15, 2011 regarding U.S. Appl. No. 12/317,983, 16 pages.

Office Action dated Feb. 25, 2011 regarding U.S. Appl. No. 12/319,027, 10 pages.

Notice of Allowance dated Nov. 4, 2011 regarding U.S. Appl. No. 12/317,983, 11 pages.

* cited by examiner

METHODS AND APPARATUS FOR CONCRETE PANEL CONNECTIONS

BACKGROUND OF THE INVENTION

The invention relates to connections for joining together precast concrete members such as panels or columns stacked one on top of the other to form building walls. These walls may be used in structures such as office buildings, parking garages, manufacturing plants and the like.

Cast concrete panels may be connected in many ways, for example cast concrete panels may be connected using a series of metal rod sections cast into an edge surface of a first panel and corresponding bores formed in the adjacent edge surface of a second adjacent panel.

However, in such an embodiment as the second panel is set in place the bore in the second panel must be carefully aligned with the rod extending from the first panel. It is therefore desirable to provide methods and apparatus concrete connection which increase the tolerance in the setting of the concrete panels.

SUMMARY OF THE INVENTION

The invention provides methods and apparatus for coupling adjacent concrete panels.

One aspect of the invention provides a method including providing a first panel, providing a second panel, the second panel being adjacent to the first panel, providing a connection member, the connection member having a first member and a second member, the first member being attached to the first panel and the second member being attached to the second panel, and coupling the first member of the connection member to the second member of the connection member.

The coupling step of the method may further include placing a coupling member over at least a portion of the connection member first member and at least a portion of the connection member second member and attaching the coupling member to the connection member first member in at least one location and to the connection member second member in at least one location.

The attaching step of the method may further include providing at least two fasteners, inserting a first fastener through a first aperture in the coupling member and into the connection member first member, and inserting a second fastener through a second aperture in the coupling member and into the connection member second member.

Another aspect of the invention provides an apparatus having a first connection member, a second connection member, a coupling member, the coupling member being coupled the first connection member in at least one location and the second connection member in at least one location, and at least two fasteners.

The first connection member may further includes a first rod, the first rod having a first end and a second end, a second rod, the second rod having a first end and a second end, and a first channel segment, the first channel segment having a first end and a second end, the first end of the channel being coupled to the first end of the first rod and the second end of the first channel being coupled to the first end of the second rod.

The second connection member may further include a third rod, the third rod having a first end and a second end, a fourth rod, the fourth rod having a first end and a second end, a second channel segment, the second channel segment having a first end and a second end, and a third channel segment, the third channel segment having a first end and a second end.

The coupling member may further include a plate, the plate having at least three apertures therethrough.

The apparatus may further include at least three nuts, a first nut disposed within the first channel segment, a second nut wherein disposed within the second channel segment, and a third nut disposed within the third channel segment.

The apparatus may further include a first fastener extending through a first aperture in the plate into the first nut disposed within the first channel segment, a second fastener extending through a second aperture in the plate into the second nut disposed within the second channel segment, and a third fastener extending through a third aperture in the plate into the third nut disposed within the third channel segment.

Another aspect of the invention includes providing a method including providing a first panel, a second panel, and a connection member, the connection member being attached to the first panel. The first panel having a top surface, a bottom surface, an inside surface, an outside surface, and a pair of side surfaces, the first panel having a ledge formed in the top surface thereof at the inner surface. The second panel having a top surface, a bottom surface, a first end surface, a second end surface, and a pair of side surfaces, a recess being formed in each side surface thereof. The method includes placing the first end of the at least one second panel on the ledge of the first panel and coupling the first end of the at least one second panel to the first panel with the connection member.

The connection member may further includes a first rod, the first rod having a first end and a second end, a second rod, the second rod having a first end and a second end, and a rotating member, the rotating member coupled to the first rod and the second rod.

The second rod may extend through the rotating member aperture and the second end of the first rod is coupled to the rotating member.

The method may further includes the connection member being rotatable between a first position wherein the first rod extends outwardly from the top surface of the first panel, and a second position wherein the first rod extends outwardly from the inside surface of the first panel.

The coupling step may further include rotating the first rod from its first position to its second position.

The coupling step further may further include filling the recess in the side surface of the at least one second panel with an adhesive substance.

The method may further include providing a second first panel.

The method may further include placing the second end of the second panel on the ledge formed on the second first panel and coupling the second end of each second panel to the second first panel.

Another aspect of the invention includes providing an apparatus for coupling adjacent concrete panels, the appartus including a first rod, the first rod having a first end and a second end, a second rod, the second rod having a first end and a second end, and a rotating member, the rotating member being fixedly coupled to the first rod and rotatably coupled to the second rod.

The rotating member may have an aperture therethrough, the second rod extending through the aperture in the rotating member.

The second end of the first rod may be coupled to an outer surface of the rotating member.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
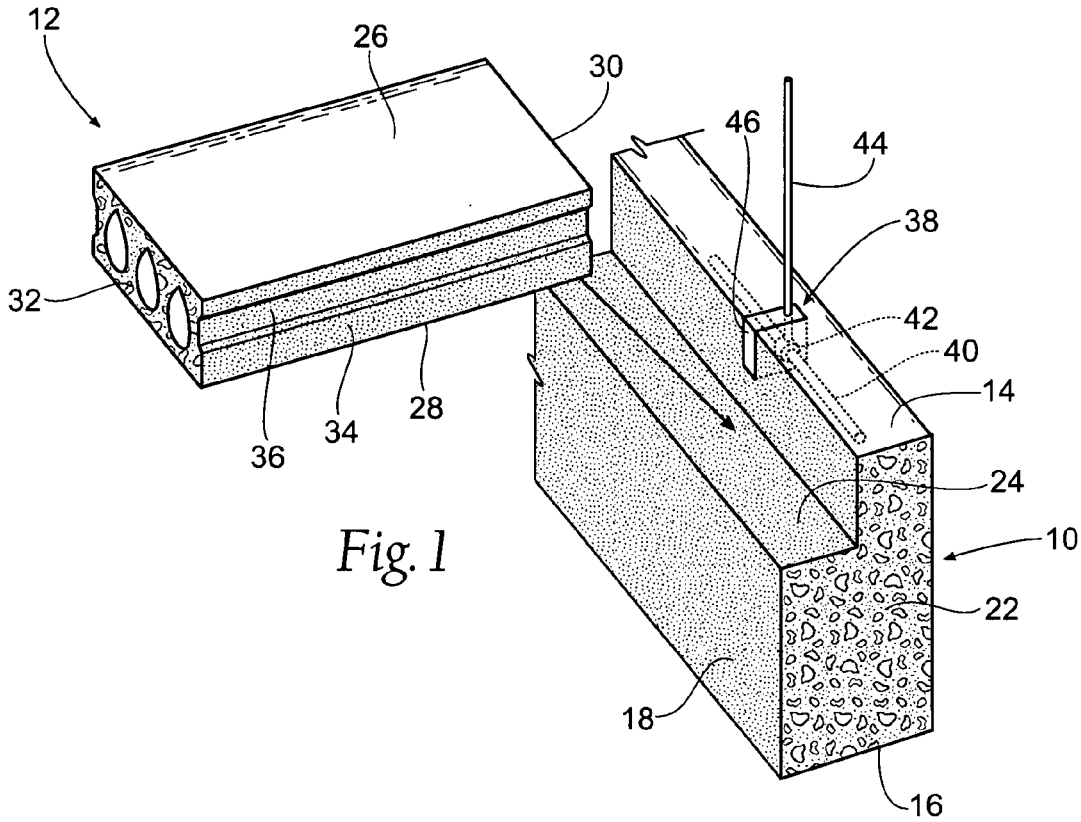
FIG. 1 is a close-up perspective view of a panel system including a first panel connected to a second panel by a connection member with the connection member being in the "up" position.
Figure 2:
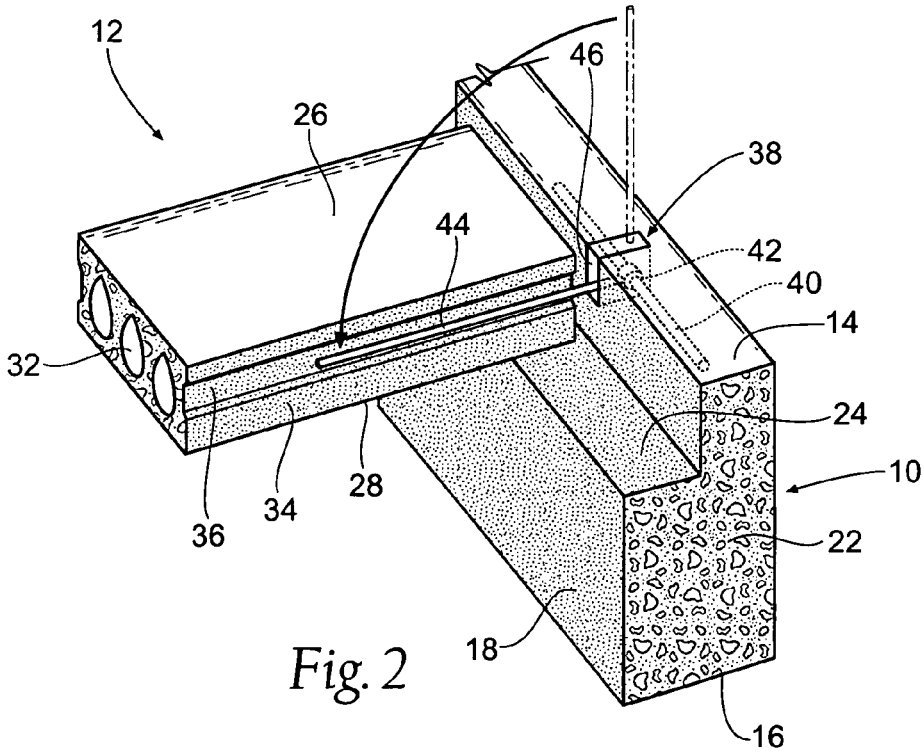
FIG. 2 is the panel system of FIG. 1 with a second panel in place and the connection member being in the "down" position.
Figure 3:
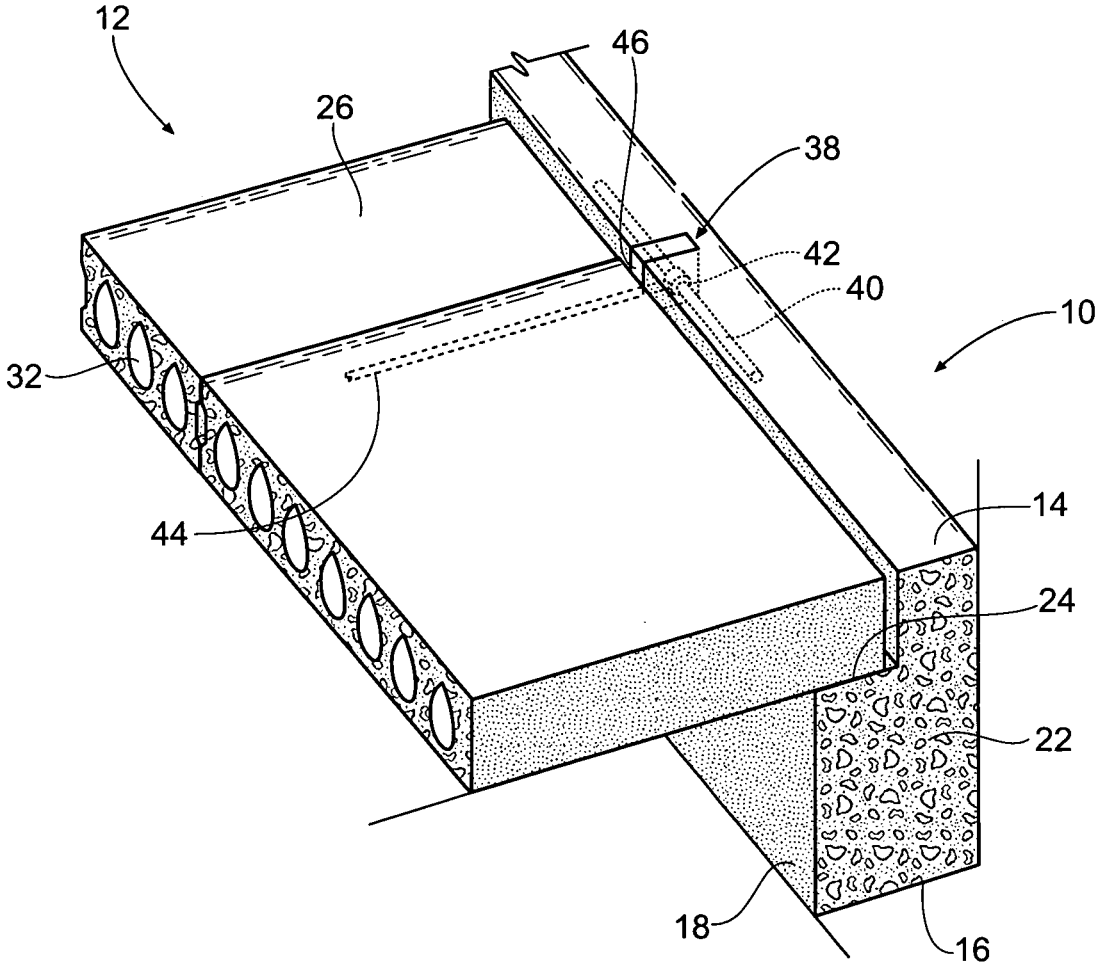
FIG. 3 is the panel system of FIG. 2 with an additional second panel in place.

At least one first panel 10 may be coupled to at least one perpendicular second panel 12 shown in FIGS. 1 through 2. At least one first panel 10 and at least one second panel 12 are provided.

Each first panel 10 is preferably generally rectangular and includes a top surface 14, a bottom surface 16, a first side surface 18, a second side surface 20, and a pair of opposed end surfaces 22. The at least one first panel 10 preferably includes a ledge 24 on the first side surface 18 thereof. The ledge 24 is preferably cast in the first panel 10.

Each second panel 12 is preferably generally rectangular and includes a top surface 26, a bottom surface 28, a first end surface 30, a second end surface 32, and a pair of opposed side surfaces 34. Preferably, each second panel side surface 34 is formed with a recess 36 therein.

Each of the first panels 10 includes at least one connection member 38 as shown in FIGS. 1 and 2. The connection member 38 includes a first rod 40 and a rotating member 42 rotatably coupled to the first rod 40. A second rod 44 is coupled to the rotating member 42 such that the second rod 44 is free to rotate relative to the first rod 40. The first 40 and second 44 rods may take any form known in the art including, but not limited to coil rods. The rotating member 42 may take any form known in the art including, but not limited to a coil nut. Preferably, each of the connection members 38 is cast in the top surface 14 of a first panel 10. The first panel 10 preferably includes a cavity 46 formed around the rotating member 42 to allow the second rod 44 to rotate. Each connection member is preferably cast in the first panel 10. The cavity 46 may be filled with a removable piece of insulation during casting. The second rod 44 is preferably cast in "upright" position as shown in FIG. 1.

In use, a second panel 12 is set in place on the ledge 24 of a first panel 10. After the second panel 12 is set in place, the second rod 44 of the connection member 38 is rotated to its "down" position as shown in FIG. 2. As discussed above, each second panel 12 preferably has a recess 36 formed in each side surface 34 thereof. As will be understood, a cavity 48 will be formed between adjacent recesses 36 when adjacent second panels 12 are set in place next to each other. These recesses 36, and resulting cavity 48, are preferably sized and configured to accommodate the second rod 44 of the connection member 38.

An adjacent second panel 12 may then be put in place. After the adjacent second panel 12 is put in place, the joints between adjacent second panels 12, particularly the cavity 48 formed between the side surfaces 34 of the second panels 12 are preferably filled with an adhesive substance, such as, but not limited to nonshrink grout. It should be understood that any number of second panels 12 may be coupled to a single first panel 10. It should further be understood that multiple first panels 10 and multiple second panels 12 may be utilized.

Figure 4:
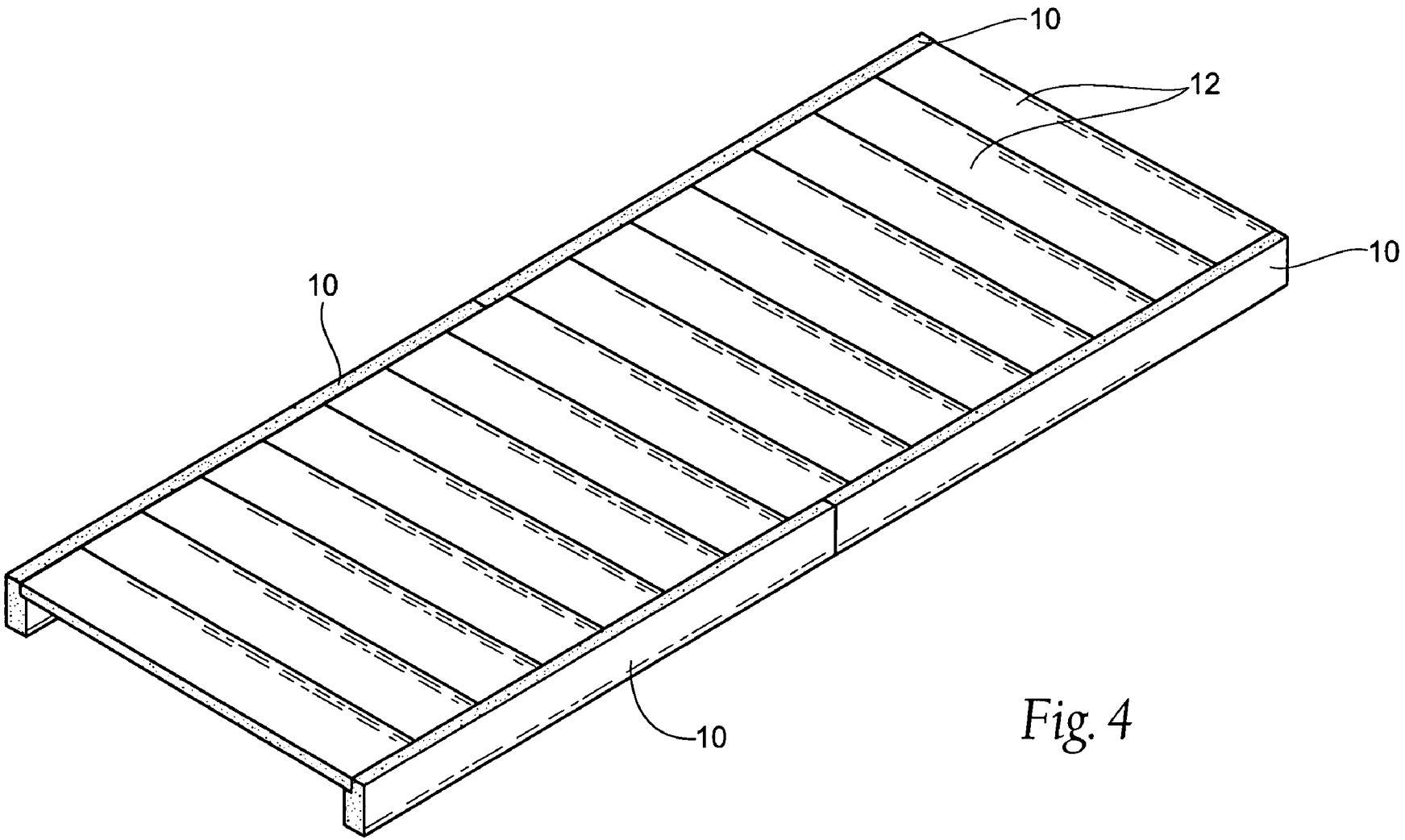
FIG. 4 is a perspective view of a plurality of first panels connected to a plurality of second panels.

It is further contemplated that, as shown in FIG. 4, two first panels 10 may be provided, and that any number of second panels 12 may extend between the two first panels 10. In this manner both the first end 30 and the second end 32 of each second panel 12 is coupled to a first panel 10 by at least one connection member 38.

Figure 5:
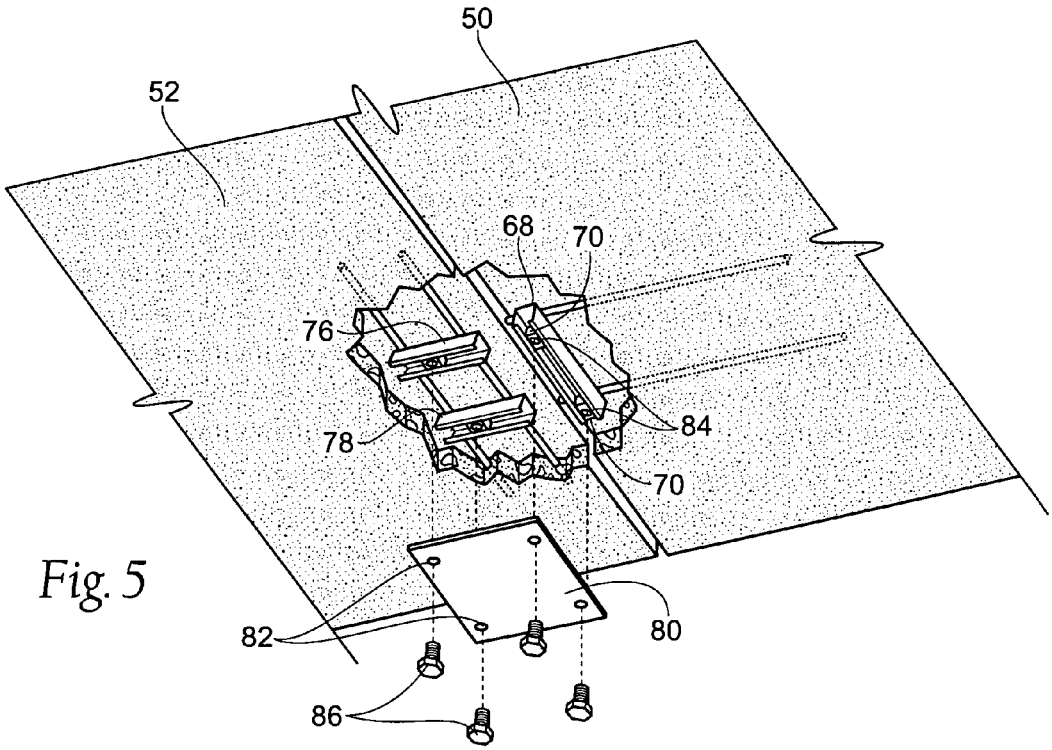
FIG. 5 is a close-up partially exploded perspective view of a panel system including a first panel connected to a second panel by an alternative connection device.

A first panel 50 may be coupled to an adjacent parallel second panel 52 as shown in FIGS. 5 through 8. In the illustrated embodiment a first panel 50 may be secured to an adjacent second panel 52 using a connection device 54 as shown in FIG. 5. The connection device 54 preferably includes a first portion 56 located near a first edge 58 of a first panel 50 and a second portion 60 located near a second edge 62 in a second panel 52. The portions 56, 60 of the connection device 54 are preferably cast in their respective panels 50, 52.

Figure 6:
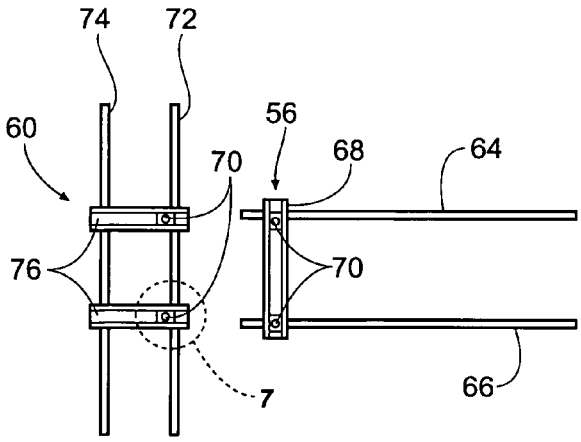
FIG. 6 is a top plan view of the connection device of FIG. 5.
Figure 7:
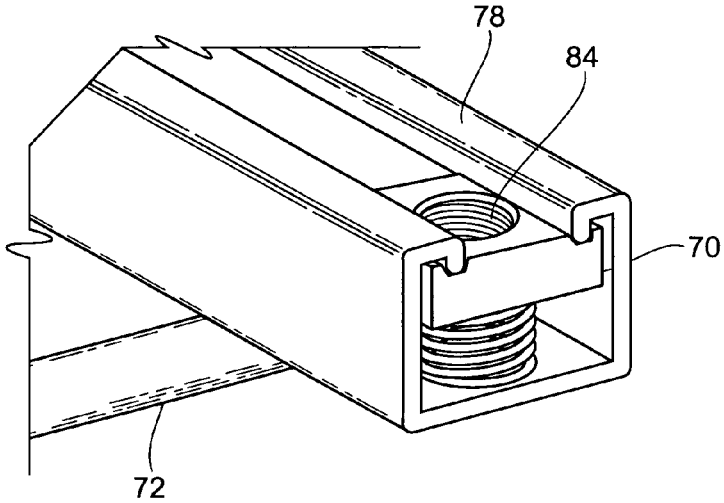
FIG. 7 is a close-up view of a portion of the connection device of FIG. 6.
Figure 8:
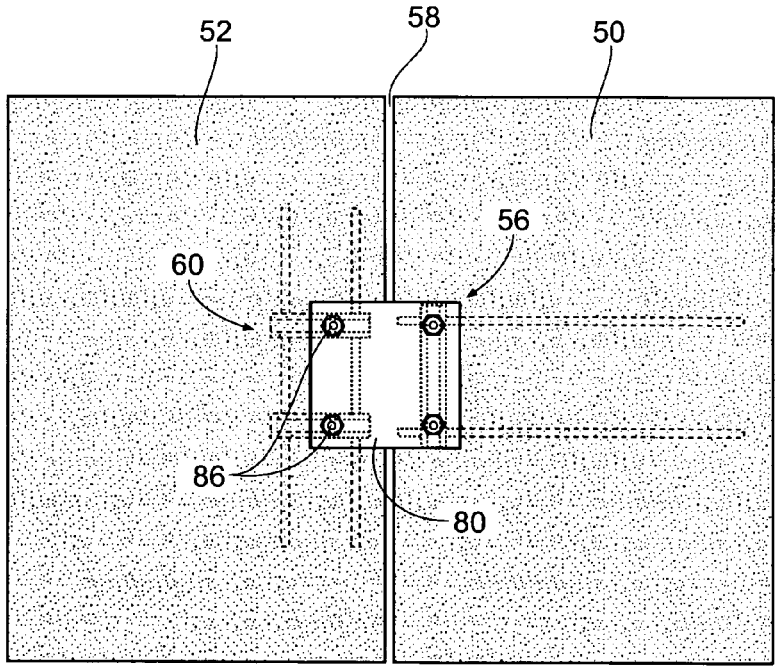
FIG. 8 is a top plan view of the connection device FIG. 6 embedded in a pair of adjacent panels.

As shown in FIG. 6, the first portion 56 preferably comprises a first rod 64 and a second rod 66 coupled to a first unistrut channel 68. A pair of channel spring nuts 70 is preferably disposed within the first unistrut channel 68. The second portion 60 preferably comprises a third rod 72 and a fourth rod 74 coupled to a second unistrut channel 76 and a third unistrut channel 78. A channel spring nut 70 is preferably disposed in each of the second 76 and third 78 unistrut channels. The rods 64, 66, 72, 74 may be coupled to their respective unistrut channels 68, 76, 78 using any means known in the art including, but not limited to welding.

In use, a plate 80 is placed over the plurality of unistrut channels 68, 76, 78. The plate 80 preferably includes a plurality of apertures 82 therethrough. The apertures 82 in the plate 80 are aligned with the apertures 84 in the channel spring nuts 70. It should be understood that the channel spring nuts 70 are slidable within the unistrut channels 68, 76, 78 to align each nut 70 with an aperture 82 in the plate 80. A fastening member 86, such as a screw, is then inserted into each of the apertures 82 in the plate 80 and into the apertures 84 of the channel spring nuts 70. The fastening members 86 may then be tightened to secure the adjacent panels 50, 52.

Although the illustrated embodiment shows only two panels 50, 52 being coupled, it should be understood that multiple panels may be coupled using the illustrated method and apparatus. Specifically, each panel 50, 52 may be coupled to another panel at each edge of the panel. In such a manner, a rectangular panel may be coupled to up to four other panels.

Although the illustrated embodiment the panels 10, 12, 50, 52 are generally rectangular, it is contemplated that the methods and apparatus of the present invention may be utilized with any polygonal shaped panel.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A method comprising:

providing a first panel, the first panel having a top surface, a bottom surface, an inside surface, an outside surface, and a pair of side surfaces, the first panel having a ledge formed in the top surface thereof at the inner surface;

providing at least one second panel, the second panel having a top surface, a bottom surface, a first end surface, a second end surface, and a pair of side surfaces, a recess being formed in each side surface thereof;

providing a connection member, said connection member comprising a first rod, the first rod having a first end and a second end, said first rod being cast wholly in said first panel, said first rod having a rotating member rotatably coupled thereto;

a second rod, the second rod having a first end and a second end;

wherein said second end of said second rod is coupled to said rotating member such that said second rod is capable of rotating relative to said first rod, and wherein at least a portion of said second rod extends into said first panel and at least a second portion of said second rod extends out from said first panel; and wherein said first panel has a cavity therein to allow rotation of said second rod about said first rod from at least a first open position to at least a second locked position;

placing the first end of the at least one second panel on the ledge of the first panel; and coupling the first end of the at least one second panel to the first panel by rotating said second rod into said recess of the second panel, into said locked position.

2. The method of claim 1 wherein the coupling step further comprising filling the recess in the side surface of the at least one second panel with an adhesive substance.

3. The method of claim 2 further comprising providing a second first panel.

4. The method of claim 3 further comprising placing the second end of the second panel on the ledge formed on the second first panel; and coupling the second end of each second panel to the second first panel.

5. An apparatus for coupling a pair of adjacent panels, the apparatus comprising a first rod, the first rod having a first end and a second end, said first rod having a rotating member rotatably coupled thereto; said first rod being cast wholly in a first panel of said pair of adjacent panels:

a second rod, the second rod having a first end and a second end;

wherein said second end of said second rod is coupled to said rotating member such that said second rod is capable of rotating relative to said first rod, and wherein at least a portion of said second rod extends into said first panel and at least a second portion of said second rod extends out from said first panel; and wherein said first panel has a cavity therein to allow rotation of said second rod about said first rod.

6. The apparatus of claim 5 wherein the rotating member has an aperture therethrough, the first rod extending through the aperture in the rotating member.

7. The apparatus of claim 6 wherein the second end of the second rod is coupled to an outer surface of the rotating member.

* * * * *